US005643055A

United States Patent [19]

Linzell

[11] Patent Number: 5,643,055

[45] Date of Patent: Jul. 1, 1997

[54] SHAPING METALS

[75] Inventor: Geoffrey Robert Linzell, Hatfield, England

[73] Assignee: Ball Burnishing Machine Tools Ltd., Hatfield, England

[21] Appl. No.: 347,320

[22] PCT Filed: May 27, 1993

[86] PCT No.: PCT/GB93/01096

§ 371 Date: Feb. 24, 1995

§ 102(e) Date: Feb. 24, 1995

[87] PCT Pub. No.: WO93/24272

PCT Pub. Date: Dec. 9, 1993

[30] Foreign Application Priority Data

May 27, 1992 [GB] United Kingdom ..... 9211232

[51] Int. Cl.[6] ..... B24B 1/00

[52] U.S. Cl. ..... 451/36; 51/298; 451/28

[58] Field of Search ..... 451/36, 28, 53, 451/55, 54

[56] References Cited

U.S. PATENT DOCUMENTS

| | | | |
|---|---|---|---|
| 3,850,590 | 11/1974 | Chalkley et al. | 51/298 |
| 3,869,896 | 3/1975 | Carr et al. | 72/108 |
| 4,087,943 | 5/1978 | Perry | 451/36 |
| 4,338,750 | 7/1982 | Ratterman | 51/281 R |
| 4,581,287 | 4/1986 | Smith et al. | 51/296 |
| 4,936,057 | 6/1990 | Rhoades | 51/317 |
| 5,125,191 | 6/1992 | Rhoades | 51/317 |
| 5,203,883 | 4/1993 | Perry | 451/36 |
| 5,235,959 | 8/1993 | Frank et al. | 451/36 |

FOREIGN PATENT DOCUMENTS 1591125 4/1970 France .

OTHER PUBLICATIONS

VDI–Zeitschrift, vol. 127, No. 17, Sep. 1985, Düsseldorf DE, pp. 675–678, K. Przyklenk, 'Druckflieâläppen', see p. 676, col. 2—p. 677, col. 1.

*Primary Examiner*—James G. Smith
*Assistant Examiner*—Dona C. Edwards
*Attorney, Agent, or Firm*—Synnestvedt & Lechner

[57] ABSTRACT

A common way of shaping a metal workpiece by the removal of material therefrom involves rubbing contact, as experienced in a conventional wedge-shaped metal or ceramic cutting tool or in abrasive rubbing using grinding wheels. In conventional cutting and abrading it is commonplace to introduce at the cutter/workpiece interface a material that principally acts as a coolant and as a chip remover but which normally has lubricating properties to minimized rubbing friction. The method of the present invention, in contrast, depends for its function on deliberately causing very high levels of friction between the tool and workpiece; it proposes a method of shaping metal in which the surface of the work piece is "rubbed" by a tool in a friction-inducing manner and in the presence of an anti-lubrication (friction enhancing) agent in a quantity and in a form such that actual friction enhancement occurs. Such an anti-lubricant allows, under some conditions, any part of the tool in rubbing contact with the workpiece surface momentarily to heat and soften the surface, whereupon, due to the system's momentum (as the rubbing action continues), the further friction caused by the tool shears off the softened surface material under and forward of the contact with the tool.

16 Claims, 3 Drawing Sheets

SHAPING METALS

BACKGROUND OF THE INVENTION

This invention is concerned with the shaping of metals by controlled removal of material from the surface of the workpiece being shaped or sized. It relates in particular to a method of improving the efficiency of some conventional metal-shaping tools by changing the tool/workpiece surface interface conditions to increase the rate at which the tool can remove metal under certain operational conditions.

A common way of shaping a metal workpiece by the removal of material therefrom involves rubbing contact, as experienced in a conventional wedge-shaped metal or ceramic cutting tool with a sharp edge (a technique generally known as "machining"). Here, the tool's cutting edge is set so it can penetrate the workpiece surface, and rubbing takes place just below the original surface level to cause material to be sheared from the surface being machined. The tool with the cutting edge can take many forms—for example, teeth on a rotating mill cutter, or a chisel-like tool in a lathe (tools of the latter type are often referred to as single point cutting tools). Alternatively, rubbing contacts can be between burnishing lands on a rotary tool, or between a polished raised ring on a linear tool (like a burnisher on a broach tool). Here the rubbing takes place only at the contact area with the surface, and material is wiped or smoothed out but generally not sheared from the surface. This method of shaping is an instance of forging, and when done cold is often referred to as cold working. Examples of the materials used in the tools used in cutting and cold working are tool steels, tungsten carbide, alumina, cubic boron nitride, and natural and artificial diamond.

Another important type of material removal used in metal shaping employs abrasive rubbing tools, typified by conventional grinding wheels. These use many very hard and small crystalline grains (or "grits") of abrasive material with a multiplicity of cutting faces (in the tool the angles of the cutting faces of these abrasive grains will be randomly distributed with respect to the machined surface). These abrasive grains range in size typically from 0.01 mm to 0.4 mm across, and are distributed at densities from about 20 $mm^{-2}$ down to less than $2mm^{-2}$. They are commonly used in lapping and honing stones, grinding wheels, superfinishing stones, and the abrasive media used in tumbling or vibratory polishing and finishing processes. Examples of the abrasive materials are garnet, emery, pumice, silica, diamond, carbides of iron, or tungsten, silicon carbide, cubic boron nitride, and aluminum oxide (alumina).

In the case of conventional abrasive tools less than 50% of the grains' contacting faces are statistically at angles suitable for efficient shear cutting; the remaining angled faces cause ploughing and a good deal of smearing and burnishing by rubbing resulting in large amounts of unwanted cold working and energy dissipated as friction-generated heat. This is wasteful, and accounts in large measure for the relative inefficiency of abrasive cutting systems when compared with conventional shear cutting described above.

In conventional cutting and abrading it is commonplace to introduce at the cutter/workpiece interface a material that principally acts as a coolant and as a chip remover (to wash the cut chips away from the cutting tool) but which normally has some (and often claimed as important) lubricating properties. Conventional theory says the lubricating properties of the coolant are important to minimize rubbing friction at sites where (in abrasive machining) the grains are not orientated favorably for efficient cutting, and to minimize friction as sheared material passes across the rake face of grains or (in conventional cutting tools) of wedge shape cutters. In this latter case clean and efficient metal removal is only possible when the rake angle is favorable, allowing the cutting element to penetrate into the surface so as to transmit a force into the material being cut that is generally parallel to the surface to allow the material immediately ahead of the tool plasticly to deform and shear from the surface. If, however, the rake angle is such (leaning forward) that the tool is inclined to ride up over the surface to be cut, then rubbing and ploughing (a sideways displacement of material) occurs, which is not only wasteful of energy but in some cases causes severe surface damage as well as inducing residual surface tensile stress.

SUMMARY OF THE INVENTION

The method of the present invention—in contrast to conventional shear cutting (or, indeed, other methods of material removal)—depends for its function on deliberately causing very high levels of friction between the tool and workpiece, and here it is perhaps useful to observe that in general friction between two hard surfaces, such as metal-to-metal or metal to abrasive, is believed to be the result of a succession of micro-welds and subsequent shears occurring at rubbing asperity contacts between the surfaces. The contacting asperities "load share" by plasticly deforming as their individual loads rise due to micro roughness. In the case of a metal workpiece surface the deformation is sufficient to crack or disrupt the workpiece's natural surface—protecting oxide layer, allowing unreacted material on that surface—pure, clean, metal—to touch the tool's surface, and so to form micro-welds between the surfaces (even with the normally oxide-coated layer of an abrasive material such as alumina or silicon carbide there will be some weak welding between the clean workpiece metal and the abrasive). Normally, these welds then shear, and the damaged, exposed surface re-oxidizes, or is covered by some material (from the lubricant/coolant) that reacts with it to form a layer that minimizes further welding. In the method of the invention, however, the level of micro-welding is increased by the use of an agent—an anti-lubricant—that actively encourages friction, specifically by introducing a material between the tool's cutting element and the workpiece surface that actively scavenges both free and combined oxygen to keep the workpiece surface bare, unoxidized metal. The result is that the energy transferred into the surface is sufficient to cause significant localized heating and softening of the surface such that yet further frictional forces imposed by the tool actually shear the surface layers away.

More particularly, the invention proposes a method of shaping metal in which the surface of the work piece is "rubbed" by a tool in a friction-inducing manner and in the presence of an anti-lubrication (friction-enhancing) agent in a quantity and in a form such that actual friction enhancement occurs. Such an anti-lubricant allows, under some conditions, that part of the workpiece surface in rubbing contact with the tool momentarily to soften and, due to the system's momentum (as the rubbing action continues), to shear away from the underlying material as a result of the continuing frictional forces generated by the tool, and form a chip (the material sheared away will normally be that material under and slightly forward of the contact with the tool). By this method of inducing localized heating and shearing, some otherwise wasted energy is utilized for useful metal removal, and much of the potentially damaging heat resulting from the increase in friction is trapped and carried off in the sheared chips. Thus, the metal removal rate of a multiple contact tool like an abrasive, or more specifically a honing stone or grinding wheel, is increased because the number of active contacts is increased—and more metal is removed with less energy consumed.

In one aspect, therefore, the invention provides a method of shaping a metal workpiece by removing material from the surface thereof, in which method the surface of the workpiece is continuously "rubbed" by a tool in a friction-inducing manner and in the presence of a friction-enhancing agent in a quantity and in a form such that actual friction enhancement occurs, and at least some of the surface material in frictional contact with the tool is sheared from the workpiece surface by the continuing motion of the tool, and discarded.

In the Specification of our International Application WO 91/19,589 there is briefly described a method of shaping a surface by a technique making use of the galling concept the Application's Specification had just discussed. This galling concept involves the actual transfer of material from one surface (the donor) to the other (the receiver), in the form of a gall, and in the context of ball peening the Specification suggests that this transfer mechanism could be of use not in binding the donor surface to the receiver surface but in actually altering the shape of the receiver surface (ball peening is technique for inducing residual compressive stress into the surface layers of an article, in which technique the surface is repeatedly impacted with one or more small hard balls, each impact flattening or denting the surface to cold work the surface material and inhibit the initiation and growth of fatigue cracks). More particularly, after drawing a somewhat inappropriate analogy with the well-known use of "sandpaper" to wear a surface away by abrasion, the Specification goes on to say that, because of the metal transfer mechanism, the galling process could be used to modify the equally well-known process of ball peening by causing the impacting balls to alter the surface shape not only by the standard plastic deformation process but also by actually removing material from the surface as a result of galling.

It should now be stated, for the avoidance of doubt and for clarification, that this modified "ball peening" process of our aforementioned International Application is fundamentally different from the method of the present invention, in that the former involves galling-derived metal removal resulting from solid phase welding following surface oxide film rupture while in the latter the metal removal is of a non-galling kind the result of lesser dynamic friction forces. In the present invention the surface of the work piece is "rubbed" by a tool in a friction-inducing manner and in the presence of an anti-lubrication (friction enhancing) agent. This rubbing involves sustained and substantial gross physical movement of the tool relative to and across the workpiece surface and in contact therewith (as typified by that resulting from the use of, say, a wire brush or a grinding wheel). It causes significant dynamic friction between the tool and the workpiece, and so leads to local heating and softening, and thus to material being dragged off following shear by the continued friction. However, in the modified ball peening method there is no bodily rubbing movement of the "tool"—the balls—relative to and across the workpiece surface while in contact therewith; despite the apparent comparison in the Application of the action to that of sandpaper, and despite the rather misleading diagrammatic Figures purportedly showing the peening process in operation, there is instead effected merely the hammer-like impact of the balls onto the surface, the balls hitting the surface and then bouncing straight off (perhaps after a short rolling motion but without any sliding or skidding across the surface). This impact results in some plastic deformation of the surface; it is the oxide film rupture arising from this deformation, coupled with the oxygen-scavenging action of the galling agent on the balls' surfaces' oxide film, that is the primary reason for the galling that then occurs, and thus for the subsequent surface modification as a result of material removal following tensile fracture as the balls bounce off.

The method of the invention can be applied to almost any kind of metal shaping process provided that there is used a technique involving rubbing friction (and so, of course, to almost any kind of workpiece). Thus, it can be applied to conventional machining (as done using a lathe, or a milling machine, or a saw, provided the tool itself rubs), and—and especially—to any of the various forms of abrading processes.

All the above mentioned processes used in the shaping of a metal workpiece depend on the removal of many small silvers from its surface on each successive rubbing contact. The size of each sliver is small, estimated to be of the order of 0.001 $m^3$ for soft materials and less than this for hard materials. In the case of a multi-contact tool system like a wire brush (perhaps with polished terminating balls anchored to the end of each wire), or "flex hone" (a wire brush with abrasive balls anchored to the ends of the wires) or a grinding wheel many thousands of contacts can be made and slivers removed within a second to give a satisfactory metal removal rate.

A grinding wheel can be described as an abrasive tool, along with honing stones, lapping stones and pastes, electroplated diamond and cubic boron nitride reamers, finishing belts, discs, de-burring medium and many others. All the abrasive tools depend on rubbing to create the essential tool/workpiece interface motion between randomly orientated small grains of hard material. This brings the individual cutting tools (grains) into contact with the workpiece surface to give them the opportunity to cut. As already noted, only those cutters with favorably positioned cutting edges and surfaces will cut (and in most abrasive systems this is less than 50%); those with unfavorably positioned cutting edges and surfaces simply cause friction heat due to the rubbing. Thus the method of the invention will improve the efficiency of all the above mentioned tool systems.

The method of the invention requires there to be caused significant rubbing friction between the tool and the workpiece surface. In the case of a grinding wheel, for example, the effectiveness of the method rises as the number and size of rubbing contacts increase as the maximum loading on the wheel is approached. Hence in the case of grinding the process is particularly useful in heavy duty applications such as plunge and creep-feed grinding. It is also useful where continuous dressing (the shaping and conditioning of the grinding surface in order to give it the optimum properties) is used—as is common in the aforementioned processes—because the free dressing debris can increase the number of rubbing contacts while the effect of the anti-lubricant is to maintain the cutting wheel's metal removal potential for a longer time, so there is less need to dress so severely (and therefore the productive life of a grinding wheel can be extended).

The method of the invention relies on the use of an anti-lubricant—a material that increases friction when placed between a tool rubbing on a metal surface and the surface being rubbed. A number of materials, and types of materials, have this property, but one particularly interesting class of materials with characteristics like this are certain varieties of silicones (in general silicones are polymers of diorganyl siloxanes [—O—Si(R2)—], and are commonly referred to as polysiloxanes).

The medium molecular weight silicones are oils, and many of these oils have in the past proved to be useful as lubricants (there are several prior Patent Specifications that discuss the advantageous combined lubricating and cooling effect achievable by utilization of silicones, although in practice this effect has not only been found less advantageous than all first thought but also only shown by those silicones containing the medium- to long-chain hydrocarbyl groups). In clear contrast, however, when short-chain hydrocarbyl group silicones are used on metals, notably iron-based metals, they have demonstrated a tendency towards the opposite effect. Indeed, those silicone oils in which the organyl groups are short chain alkyl groups—and specifically those wherein the alkyl groups are methyl groups—can, when used in small quantities (to form naturally thin films), in fact result in predictably and significantly increased levels of friction between sliding metal surfaces, so acting as anti-lubrication agents. Contrary to anything suggested by the Art, these methyl silicones appear to have little or no static or boundary lubrication properties for metals, and appear instead positively to promote friction. Accordingly, for applying the method of the invention there is very preferably employed, as the material promoting the friction enhancement (as the "anti-lubricant"), a suitable silicone oil of the dimethyl or hydrogenmethyl type. Particular silicones are discussed further hereinafter.

The friction enhancing agent may itself directly promote friction enhancement, or it may do so indirectly, by giving rise under the conditions of use to a material that does itself promote friction enhancement. The preferred silicone oils are believed, when subject to the heating (chemical) or shear forces (mechanical) generated by minimal initial lateral rubbing motion, to break down chemically into a form that promotes friction enhancement.

The atmosphere of Planet Earth being to a large extent the reactive element oxygen, the surfaces of most common metals (such as iron or Aluminum) are covered in an oxide film. Accordingly, to promote friction enhancement between the tool and the workpiece it appears desirable to employ a material that acts to remove any surface oxide layer (and preferably to stop such a layer instantly re-forming in the tool contact region, which can perhaps be accomplished by scavenging free oxygen from the rubbing area itself). It is believed that such an oxide-layer-removal and oxygen-scavenging action is effected by the preferred silicone oils. More especially, it is believed that the preferred silicone oils are materials that break down into products having strong oxygen-scavenging properties, whereby not only is the surface of the workpiece cleaned of some of any oxide layer thereon but the remaining material acts as a barrier to delay further oxygen entering the contact area and re-establishing the oxide layer during the rubbing period.

The anti-lubricant action of slicone oils, particularly the polydimethylsiloxanes, was first exploited to gall and join metals as described in our PCT/GB 91/00,950. Their behavior as friction enhancing agents is more moderate under the ambient conditions of the rubbing used in the method of the invention, but nevertheless similar materials are suited for use therewith (although in some instances it is beneficial to blend them with other substances, to match operating needs ). Thus:

Materials that are liquids and of relatively low viscosity (about 50 c/s or less, some as little as 10 c/s) are preferred, because they are easier to insert into the interface and appear to be more effective as friction promoters. The preferred medium molecular weight poly(dimethyl)siloxanes are of this sort, especially those materials commercially available from Dow Corning under the Marks MS 200, Dow Corning 531 and 536, and Dow Corning 344 and 345, all of which are fully described in the relevant Data Sheets. The 531 and 536 materials, whose normal use is in polishes, are amino, methoxy functional polydimethylsiloxanes (the contained functional—that is, reactive—amino and methoxy groups cause the materials to bond chemically to the surfaces to which they are applied, and to polymerize further in the presence of water vapor, changing from liquids into rubbery solids). The 344 and 345 materials, normally used in cosmetic preparations, are respectively cyclic tetramers and pentamers of dimethyl siloxane. Other preferred silicones are mentioned below.

The polysiloxanes are noted for their temperature stability, but nevertheless they break down under severe heating—mainly at temperatures above 300° C., which are to be expected at the asperity contacts when two surfaces are rapidly rubbed together, although when catalyzed by unreacted metal this breakdown can occur at temperatures as low as 100° C.—to give silyl moieties that are highly active scavengers of oxygen, and will easily remove the oxygen from the vicinity in an oxide layer such as that found on an iron or aluminum body, locally reducing the layer to the metal. Thus, when used as the friction-promoting material, and inserted as a thin film between, say, two steel surfaces, the rubbing of the surfaces under minimal initial movement and contact pressure causes the polysiloxane to break down, the breakdown products locally remove (wholly or in part) the protective oxide layer, and the subsequent rubbing produces local surface heating and shearing away of the heated material. However, because the temperatures generated at asperity contacts will to a considerable extent depend upon the nature of the materials—copper being much softer than iron, and being a better thermal conductor, copper-copper contact results in lower temperatures than iron-iron contact, for example—the particular (polysiloxane) friction-promoter may need to be chosen carefully to reflect this difference (and it may even be desirable to select a more reactive silicon material, such as one of the silanes commonly employed as precursors in the preparation of siloxanes).

In situations where it is difficult to achieve the conditions to de-stabilize an externally applied polydimethyl siloxane an alternative and more reactive polymethylhydrogen siloxane may be substituted.

The friction-enhancing agent can be one of several materials, one being variants of polydimethylsiloxanes (silicone oils) with a basic viscosity of typically less than 50 c/s. In many instances one of these silicone oil materials can be used in its normal "neat" form by simply applying it direct to the actual tool/workpiece interface. In other cases it can be blended or modified and applied in a variety of forms to meet essential features of the applications. For instance, it can be applied as a thick "water-in-oil" emulsion, with the constituency of a typical cosmetic hand moisturizing cream and with the friction-enhancing agent characteristic, for use to provide the optimum wetting for the grains/grits in a lapping paste. In other cases it is possible to impregnate a porous rubber or sponge and/or to raise the viscosity of such an emulsion form a semi-solid block, like a cake of soap. This "cake" can then be used to retain abrasive grains/grits. On rubbing the cake on a surface a small amount of water is released from the emulsion to wash away swarf, while the anti-lubricant is available to allow maximum metal removal action.

Alternatively, the silicones can be blended as an "oil-in-water" emulsion that can be diluted further by the addition of water for use as a conventional grinding coolant fluid combined with the friction-enhancing agent and with other essential additives to control bacteria, corrosion and maintain the compounds' chemical stability. In many cases, such as in vibratory bowl de-burring and metal finishing systems, it is essential that the friction-enhancing agent can be washed or flushed off/out by a flow of clear, wailer (this makes it compatible with equipment such as pumps and settlement tanks that are used in conventional water based coolant systems in grinding).

It is thought that some of the preferred silicones, especially the more reactive types, can be reacted directly onto the rubbing or cutting grains at the surface of a tool during a machining process, provided a catalyst is available and the tool temperature is high enough, and it is believed that this may be of particular commercial value. The catalyst is usually the exposed unreacted workpiece material, and the tool temperature usually well exceeds the 150° C. during and immediately after contact, which is the temperature quoted as needed by the silicone manufacturers for reacting hydrogenmethyl materials. PPG Speciality Chemicals Inc. supply alpha, omega di-functional silicone polymers the ends of which are modified with an organic radical capable of undergoing rapid reaction with the cutter or workpiece; these may be used for the transport of the silicone molecules into the highly stressed tool/workpiece interface. This principle may be important in positioning the silicone material, since due to the exceedingly high surface contact and local hydraulic pressures very little fluid is carried between the surfaces as free fluid. This dynamic reactivity is thought to be very important in machining the more difficult materials such as those that are very hard and those made of nickel alloys.

One possibly especially advantageous way of forming a grinding wheel or abrasive stone where the basic material is porous can be simply to impregnate the wheel or stone with a mixture of a reactive silicone (such as Dow Corning type 1107 material) and a catalyst (such as 10% tin octoate), the whole then being baked (for up to 2 hours at 150° C.); in this way the silicone can be bonded to and retained within the structure of the abrasive body indefinitely. This is a cost effective, simple, convenient and practical way of ensuring the anti-lubricant is always available as the abrasive wears, and it eliminates the need for a special coolant or for making any other modifications to an otherwise conventional machine. The reactive silicone can be either a branching type such as the 1107 or a linear silicone molecule using one of many different radical terminators, a typical material being that sold by Mazer Chemical' under the mark MASIL SFR 700. The former forms a "fish net" over each abrasive particle and its bond posts, whereas the latter behave rather like sea-weed waving in a light current, being secured at one end only or looped and secured at either end. A combination of the two is particularly effective, since the propensity for direct bonding of the linears to most abrasive materials is limited because of their inert nature. The cross-linked structure formed after reaction is only weakly bonded to the abrasive grains, and behaves as a helpful slow release mechanism, and there is little silicone material wastage within an abrasive body like a grinding wheel. If excessive amounts of silicones, particularly the cross-linking variety are used, they can substantially reduce the porosity of a wheel. By way of an example a specific case is quoted hereinafter describing this technique.

The method of the invention requires the use of a friction enhancing agent in a form and in an amount such that actual friction enhancement occurs. Some indication has already been given as to what form the friction-enhancing agent might take—a neat liquid, or an emulsion of some sort—and although it is not easy to be precise about this it might here be helpful to note that because the material is required to cause friction rather than lubrication it should be employed in some "thin" form (rather than a thick, oily variety), possibly either a liquid of very low viscosity and high mobility or even a gas or vapor, and in correspondingly sparse, small amounts (rather than large amounts that would inevitably provide at least some surface-separating, and thus "lubricating", effects), possibly no more than sufficient to create a layer over the surfaces a few molecules thick.

As has previously been discussed, the method of the invention is believed to involve the surface of the workpiece being locally heated and sheared by the continuing wheel-derived frictional forces coupled thereto. The strength of this coupling in compression exceeds that of the surface material, so the energy is transmitted into and across the surface layer, which is therefore rapidly strained, and so becomes hot, and softens. The strain rate is related to tool speed; practice shows that tool speeds in excess of 10 m/sec provide satisfactory metal removal rates when grinding but that much lower speeds are sufficient for lapping (where there is often a perceptible increase in vibration).

Now, the rubbing action leaves residual compressive stress in the area from where the chip came. In the plasticly strained zone under the tool the temperature rises rapidly, and the sub-surface metal cannot conduct away the heat at the rate it is generated. The material softens, and for most metals (such as aluminium and iron alloys) there will be a decrease in flow stresses. The softening is concentrated in a strain zone starting under and running slightly ahead of the tool (in the direction of motion of the tool). Ahead of the tool the strain zone tends outward towards the surface. For optimum results the temperature increase should result in local melting (maximum softening), which will completely eliminate strain hardening. This phenomenon is known as adiabatic softening.

In the method of the invention the workpiece is continuously rubbed by the tool. The term "continuously" is used here to mean that the rubbing motion involves contacting bodily movement for a significant—that is, a prolonged or extended—length of time (relative to the type of shaping operation being effected) rather than a mere transitory interaction. However, this does not mean that the rubbing should be unceasing or unbroken; for example, when using a grinding wheel the workpiece surface is continuously in contact with the wheel, but individual portions of the wheel's grinding surface move into and then out of contact with the workpiece surface. Indeed, for best results the rubbing action should be regularly interrupted by disengaging the contacting surfaces (as is the case with a rotating grinding wheel), by a reversal or change of direction of rubbing (in the case of a lapping or vibrating operation), or by "pecking" (an oscillatory to/fro motion as used in honing), so that different grains on multi-faced abrasive surfaces come into contact and/or the formed chip or swarf is allowed to be broken up and removed from the tool contact point vicinity to prevent clogging.

The method of the invention can be applied in all sorts of metal-removing process, as noted above, and a few of these are now discussed in more detail.

One such method involves the use of tools that essentially have no sharp cutting edges, and consist merely of a series of smooth rubbing contacts, each of which is able to remove a sliver or chip of material at each discrete rubbing contact (tools with smooth surfaces give very smooth low damage surfaces with exceptional tribological properties). If the conditions are favorable, the bulk of the heat is removed in the chip—for this the chip must be sheared at very high speed—and there will be remarkably little damage to the machined surface (a very important benefit in reducing subsequent wear in service). This applies especially to surfaces machined with smooth surface tools. Furthermore it anticipates the practical use at low temperatures of disc saws the edges of which are serrated with gentle rounded forms in place of sharp teeth. This use of rounded cutter tool forms in place of traditional sharp cutters has, in the case of rotary tools, the potential (more than in the case of the conventional grinding wheel) to modify the residual stress at the surface, while if the tool rotates with sufficient energy it significantly reduces surface damage due to material removal by adiabatic shear. This produces a slightly undulating surface with the favorable residual compressive stress to make a highly favorable surface with improved (reduced) wear potential for use in sliding or rolling contact.

Another important practical application of the method of the invention is in that form of grinding wheel utilization known as creep feed grinding, where very high metal removal rates are achieved by slowly (creep feeding) driving a course abrasive wheel into a heavy cut. A coarse abrasive wheel notionally has fewer rubbing and cutting contacts than a fine wheel, but if a fine abrasive—as produced when the wheel is dressed—is additionally present then the cutting rate is increased because of the increase in the number of cutting contacts at which the anti-lubricant can act.

The method of the invention can be used not only with abrasive wheels but also with many of the conventional abrading, de-burring and finishing tools utilized in industry, such as those using abrasive loaded nylon filaments, non-woven abrasive materials, coated abrasive belts, flap wheels, and cloth buffs, and is especially advanatages when employed with abrasive liquid or bar compounds to increase abrading contacts. The physical shapes of the flexible abrasive tools include wheels, strips, cups, discs and end types among others. The idea is particularity beneficial in the case of abrasive sticks (for hand polishing or vibratory media) and for slurries (used for polishing a wide range of metal surfaces in equipment such as vibratory bowls or tumblers).

The range of uses for the method of the invention applies to virtually all abrasive processes. It also encompasses a range of anticipated tool types that are analogous to conventional cutters but do not necessarily have sharp cutting edges.

BRIEF DESCRIPTION OF THE DRAWINGS

Various embodiments of the invention are now described, though by way of illustration only, with reference to the accompanying Drawings in which.

DESCRIPTION OF THE PREFERRED EMBODIMENTS

Figure 1:
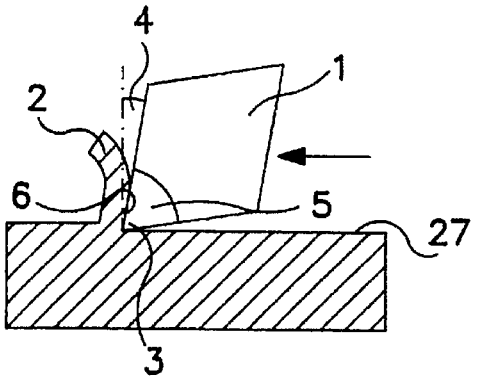
FIG. 1 (PRIOR ART)
FIG. 1 shows a conventional wedge shape rubbing cutting tool.
Figure 2:
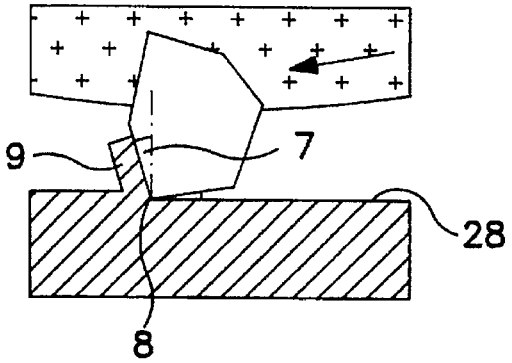
FIG. 2 (PRIOR ART)
FIG. 2 shows the cutting (shearing) action of a favorably oriented grain on the surface of a rotating grinding wheel.
Figure 3:
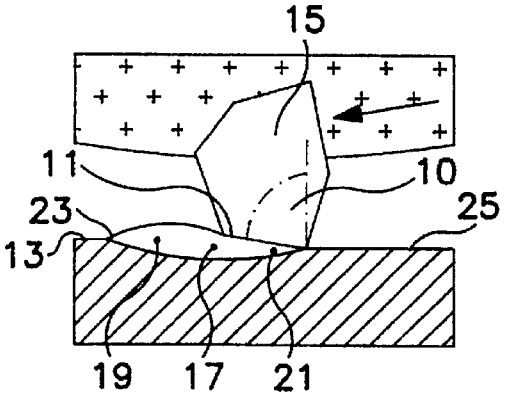
FIG. 3 shows the cutting action by the method of the invention of a grain unfavorably oriented for conventional cutting, on the surface of a rotating grinding wheel.

In conventional metal cutting (planing), illustrated in FIG. 1 using a single point cutter (1) material is sheared from the surface (2) by plastic strain as a sharp cutting edge (3) ploughs through the material. This is most efficiently done when the rake angle is "positive" as shown (4); indeed, true shear cutting as shown is only possible when the angle of attack, or "rake" angle, is such that shearing rather than rubbing occurs. It requires generally a sharp edge on a wedge shaped tool with an inclusive angle (5) usually of less than 150°. For best results on a single point tool it needs a slight forward "rake" angle 4 to allow sheared material to flow up and across its face with minimum resistance at the rake face (6). Incidentally, the aforementioned resistance is due predominantly to shearing of unreacted material that has welded to the rake edge (front) of the tool. However, in abrasive grit systems (FIG. 2) it is impractical always to have a favorable rake angle (7), and they are therefore much less effective metal cutters. The negative rake angle 7 causes significant downward forces resulting in greater elastic and plastic deformation, and induce additional compressive stress at and below the surface about to be shear cut (8). As stated metal removal in conventional cutting methods is due to shearing at relatively low strain rates caused by the tool ploughing through the material near to and parallel to its surface. This results in a more heavily deformed chip (9). The shear action becomes less effective as the rake angle goes negative (beyond –0°), and it will normally cease entirely at about –60°, when rubbing commences (10: FIG. 3). Rubbing is the essential trigger to start the method of the invention.

In fact, the method of the invention becomes more effective as the angle of attack approaches –90° and rubbing at the tool work-piece interface (11) increases, and it is most effective generally in the range –60° to –90°. This method therefore complements conventional cutting, because the method starts where conventional cutting stops, to extend the metal removal capability of a given cutting system. The effectiveness is increased dramatically by increasing rubbing rates (tool speed).

Figure 4:
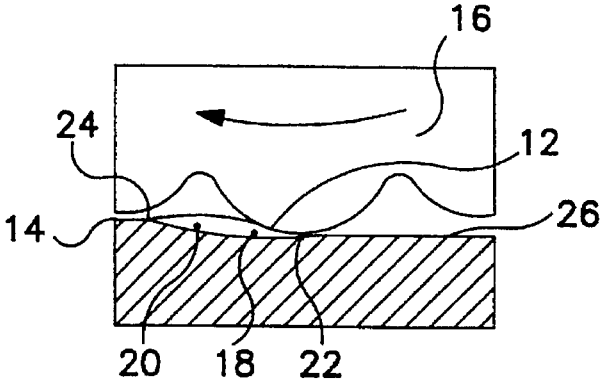
FIG. 4 shows the cutting action by the method of the invention of a rounded rubbing contact land (again, the tool section is shown on the edge or surface of a rotating wheel)

As represented in FIGS. 3 and 4, the method uses a friction enhancing agent material which causes a rapid increase in friction when trapped between the surface 11 and the cutter (12). The increase in friction is due to the friction enhancing agent being applied generally to the surface (13, 14) ahead of the rubbing tools (15, 16). This leads to rapid localized surface heating and softening (and thus to the shearing of workpiece material (17, 18) from the surface. The nature of the friction coupling, and the compressive force the surface is under due to the rubbing, combine to make the coupling stronger than the "linkage" between the softened surface material and the workpiece body, and so allow a chip (19, 20) to be sheared off.

The rubbing motion must have sufficient energy in terms of speed (kinetic energy) to cause a high strain rate in the substrate under the contact 19, 20. When the metal can no longer conduct away heat at the rate it is generated there will be a temperature rise in the strained zone (21, 22). The material softens, and in most cases there will be a drop in flow stresses. The softening is concentrated in a narrow band running ahead and tending out towards the surface (23, 24). The local heating will approach melt temperatures to virtually eliminate strain hardening in the shear zone. This phenomenon has been described as Adiabatic Softening.

The surface created by adiabatic shearing (25, 26) is considered to be highly superior to that of a conventional sheared cut (27, 28: FIGS. 1 & 2); the adiabatic effect seems significantly to reduce surface and near surface damage within the substrate (a conventional shear cut leaves residual tensile stress in the near surface grains, as well as causing strain hardening and considerable torn discontinuities).

Figure 5:
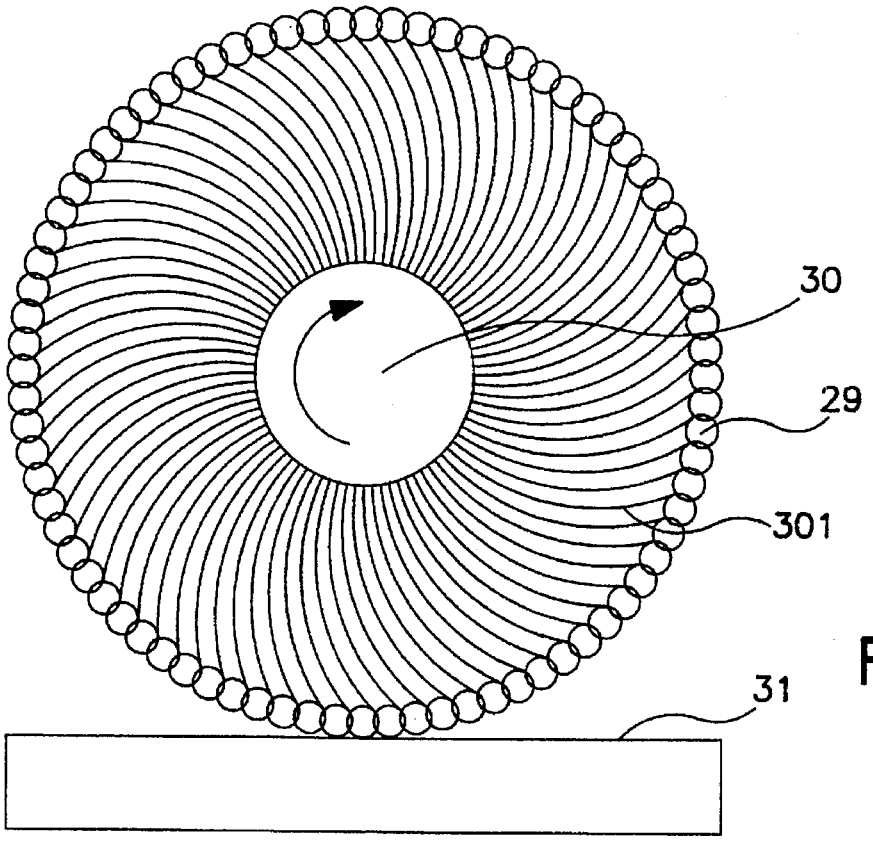
FIG. 5 shows a wire brush with small spheres attached to each wire, the assembly being rotated at speed and rubbed against a surface to remove metal.

The rubbing action of a wire brush will be concentrated at many small contact points, such as a point on a bent wire surface or at the tip of a wire. This will tend to leave a heavily lined/grooved surface. However, if a small sphere is attached to the tip of each wire, as shown in FIG. 5, then the resulting surface finish is very smooth. If a number of spheres (29) made of t suitably hard material are joined to a central hub (30) via flexible wires (301) and the whole assembly is then spun at high velocity, like a wheel, then the arrangement can be used effectively as a grinding wheel to machine hard surfaces (31)—especially in the presence of an anti-lubricant in accordance with the method of the invention.

Figure 6:
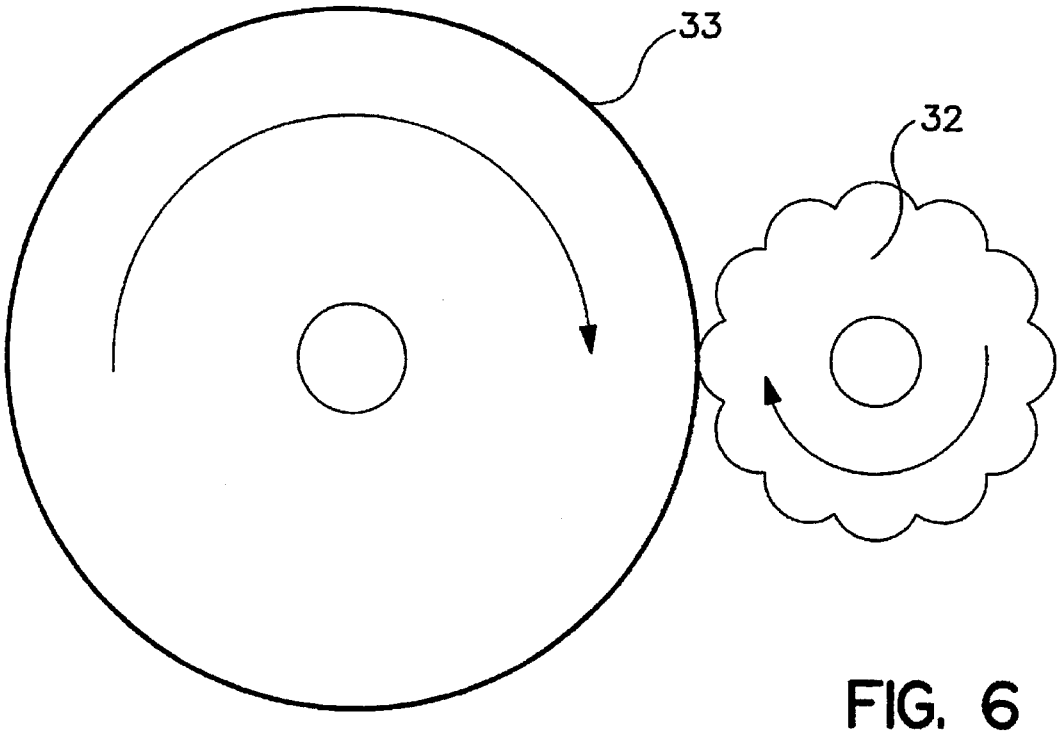
FIG. 6 shows a tool wheel being rotated in the opposite direction to the work-piece in a lathe (at each contact of the tool and work-piece a sliver of material is removed from the work-piece)

The concept of a spinning tool like a wire brush with spheres or other shapes as rubbing elements can take many forms. Indeed, it can extend to a solid wheel with slightly raised portions as shown in FIG. 6 (although the tool (32) here is shown machining a circular spinning surface (33), it could equally well operate on a flat surface (as shown in FIGS. 1 to 5). This machining of a spinning workpiece (mounted in a lathe, perhaps) with a (rotary) rubbing tool 32 has several variations. The tool could (again) be a wire brush, or it could be a wheel with an interrupted surface or with hard metal inserts. And rotating the tool 32 at very high speed in the opposite direction to the work-piece 33 provides the required surface speed in the general range of 3 to 30 m/sec and kinetic energy at the interface (34). At each contact the behavior shown in FIG. 4 occurs to remove metal. The practical significance of this is in the superior quality of the surface produced, with its very low surface and subsurface damage rate. By relating the speed of the tool to that of the work-piece it is possible to control the morphology of the surface precisely. This allows surfaces with very precise distributions of shallow scooped-out and very clean smooth areas, and this has important optical and tribological features. If the speeds are synchronized then distinct patterns can be machined onto the surface by repeatedly machining the same areas.

The advantages of the method of the invention are now illustrated with reference to the results of two sets of abrasive machining tests.

Lapping Tests

A cube of steel weighing 2 kg had three equispaced soft steel pins placed at 25 mm centers to ensure equal loading on each. One Test used pins of 5 mm diameter, a second pins of 3 mm diameter; in each case the pins projected 10 mm from the cube base. They were ground level, and the overall height was recorded.

A Norton Abrasives IB8 "INDIA" sharpening stone 205 mm long by 55 mm wide by 25 mm high was set in a shallow tank and flooded with one or other of two metal working fluids to cover the test surface to a depth of 2 mm. The two fluids compared were CASTROL 500 varicut (the Prior Art) and Dow Corning 1107 silicone fluid (the method of the invention). The fluids were chosen have similar viscosities.

The weight was then placed on the stone coarse side up—so the pins were in contact with the coarse side of the stone. The weight was coupled via a connecting rod approximately 250 mm long to a 50 mm radius driven arm rotating at 1 rev/sec. The test pins were stroked to and fro across the surface of the stone, and the rate of material removal was periodically measured.

The results—the total volume (in $mm^3$) of metal removed from all three pins after lapping for 4 minutes—were as follows:

| Pin dia. | 3 mm | 5 mm |
|---|---|---|
| Castrol Varicut | 1.22 | 0.67 |
| DC 1107 silicone | 2.14 | 1.09 |

Approximately 75% more material was removed from the 3 mm pins and 63% from the 5 mm pins when using silicones. There was a tendency for the pins to squeal only with the silicones. This was thought to be due to vibration resulting from the higher level of friction, and would be expected slightly to enhance the metal removal rate (checks with very short pins still showed about 10% less improvement overall, perhaps supporting the vibration theory). Thus it is anticipated the introduction of anti-lubricants might be used deliberately to induce vibration to improve metal removal rates. Indeed it would seem feasible to introduce resonant tool mounts to hold rubbing, cutting or abrading tools.

Grinding test

A 200 mm diameter Norton 38A60K5VBE alumina grinding wheel was mounted in a Jones and Shipman 1400 surface grinder running at 2600 rpm. A mild steel specimen of 5×12 mm cross section was mounted with 10 mm of grinding stock protruding from a bolder at one end of a balanced beam hanging at its central pivot point on frictionless hinges. The beam was so positioned relative to the wheel that the center of the specimen was on the center line of the wheel. The narrow 5 mm section of the specimen was across the wheel (the cut width) so the longer 12 mm section was the cut length. A load of 6 kg weight was placed on the other end of the beam to apply a force of 59N between the specimen and wheel normal to the wheel surface.

The beam was instrumented with a first transducer to measure the tangential force acting on the specimen as it was forced against the rotating wheel, and a second transducer measuring the metal removal rate. These transducers were calibrated, and the results recorder on a two-channel chart recorded running at 25 mm/sec.

Coolant fluid was applied through a flat nozzle with an orifice 15 mm wide by 1 mm high. The back pressure on the orifice was 0.6 bar. The nozzle was fixed horizontal, and positioned 15 mm in front of the specimen and bedded onto the wheel to grind a matching angle to the wheel, then set at a gap of 0.5 mm from the wheel surface (still at a horizontal inclination).

For the purpose of demonstrating the method of the invention three sets of test were performed, each set comprising four individual grinding tests. The grinding specimen was soft mild steel in all the tests. The grinding wheel was dressed before each test with a single point pneumatic dresser traversing the wheel in 0.7 sec total of six times. The dressing depth was 0.1 mm total, set on the first pass.

Figure 7:
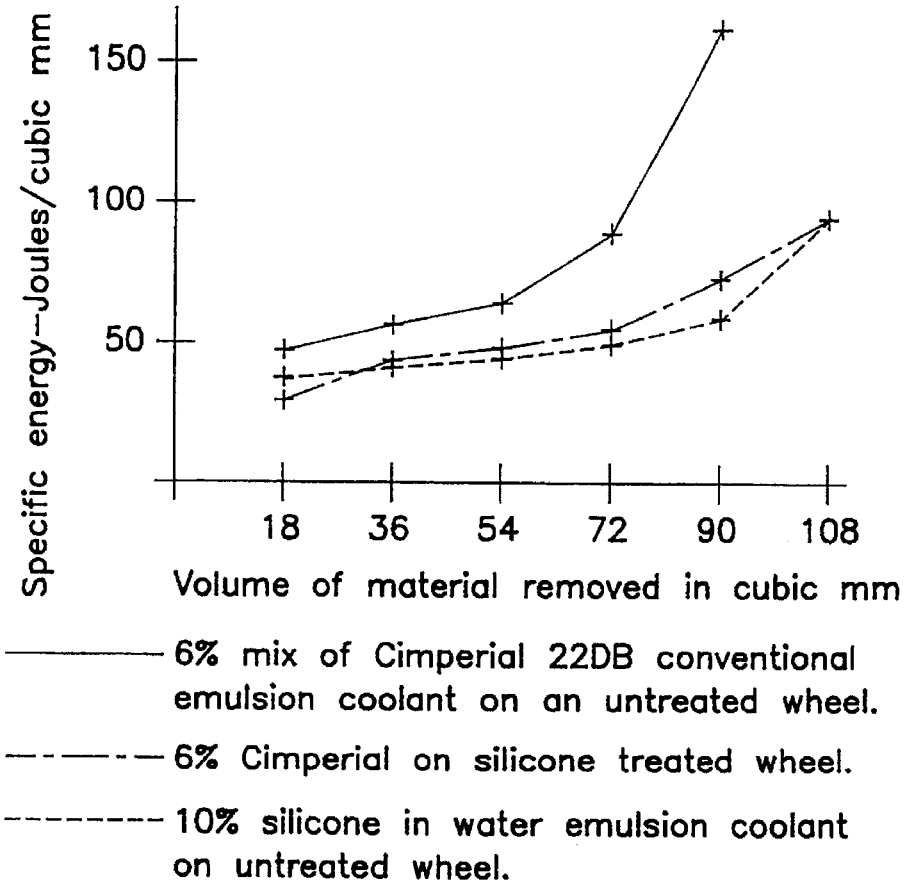
FIGS. 7–8 are graphical representations of the effect of silicones on grinding wheel performance.
Figure 8:
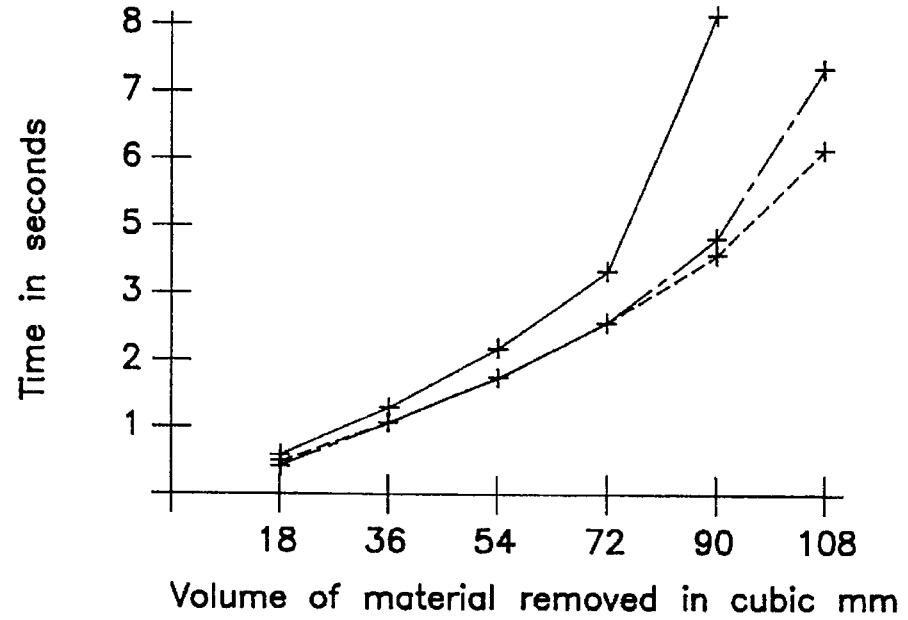

For purposes of comparison four tests were performed using for cooling a 6% mix of Cimperial 22DB heavy duty grinding fluid manufactured by Cincinnati Milacron. The wheel was as supplied by Norton. Data was recorded on the pen recorder, and from this the energy consumed to remove one cubic millimeter of steel was calculated (known as the "specific energy"). The energy consumed was plotted against the material removed as shown in FIG. 7. Also, the time taken to remove material was plotted against the material removed (this is shown in FIG. 8).

The wheel was then changed for another of the same type but impregnated with friction enhancing agent (90 ml of Dow Corning 1107 material was mixed with 10 ml of tin octoate, and this was painted onto the wheel with a paint brush; the wheel was then heated to 150° C. for 2 hours in a ventilated oven). Otherwise, the same procedure was followed as in the previous tests—again using the Cimperial 22DB coolant. The results are plotted on the same graphs (FIGS. 7 & 8).

The original wheel was restored for the last four tests, but the coolant was changed to a silicone oil-in-water emulsion (with 10% silicone content) mixed from PPG Speciality Chemicals DF230S. In this test the silicones were applied to the wheel via the coolant stream. Again the results were recorded, and are plotted in FIGS. 7 & 8.

It can be clearly seen that while, in these tests, there was little difference in terms of metal removal rate or specific energy between the two methods of applying the silicones, there was a significant increase, ranging from 5% to 50%, in the metal removal rate using silicones as compared to not using them, coupled with a 30% to 50% reduction in specific energy. Also, the original dressing cut was maintained longer on the wheel when silicone was available (the non-silicone cut become much less efficient after 72 $mm^3$, whereas in the tests with silicone the wheel was still cutting reasonably after 100 $mm^3$ had been removed—a 40% extension of cutting life per dressing).

What is claimed is:

1. A method for shaping a metal workpiece by removing material therefrom by continuously rubbing a surface of said workpiece with a tool in a friction inducing-manner so as to cause the formation of micro-welds between the workpiece and the tool and the subsequent breaking of the micro-welds, the method comprising the steps of: promoting the formation of micro-welds by effecting said rubbing in the presence of an anti-lubricating agent in a quantity and in a form such that actual rubbing friction enhancement occurs, and at least some of the workpiece material at said surface in frictional contact with said tool is sheared from the surface by the continuing motion of said tool, and discarded.

2. A method as claimed in claim 1, wherein said tool is selected from the group consisting of wire brushes, hone stones, "flex hones", grinding wheels, and tumbling, lapping or polishing media.

3. A method as claimed in claim 1, in which said anti-lubricating agent has a viscosity as low as 10 c/s.

4. A method as claimed in claim 1, in which said anti-lubricating agent is one or more silicone.

5. A method as claimed in claim 4, in which said silicone is a polydimethyl or polyhydrogenmethyl siloxane.

6. A method as claimed in claim 1, in which said anti-lubricating agent is used in its normal "neat" form by applying it direct to the tool/workpiece interface.

7. A method as claimed in claim 1, in which said anti-lubricating agent for an abrasive tool is impregnated into said tool.

8. A method as claimed in claim 1, in which said rubbing action is regularly interrupted by disengaging the contacting surfaces or by a reversal or change of direction of rubbing.

9. A method of shaping a metal workpiece with a tool by increasing rubbing friction attributed to micro-welds between the workpiece and the tool, the method comprising the steps of:

(a) rubbing a surface of the workpiece with said tool in a friction-inducing manner; and (b) delivering an anti-lubricating agent to the rubbed surface to increase the rubbing friction between said workpiece and said tool caused by the rubbing step.

10. The method of claim 9 wherein the tool includes some flats and the friction caused by the flats is enhanced because of the presence of the anti-lubrication agent.

11. The method of claim 9 further comprising the step of continuing the step of rubbing the workpiece with the tool in the presence of the anti-lubricating agent until all of the desired workpiece material has been sheared from the workpiece leaving a desired shape.

12. The method of claim 9 wherein the tool is selected from the group consisting of wire brushes, hone stones, grinding wheels or polishing media.

13. The method of claim 9 wherein the tool is a multi-contact tool.

14. The method of claim 9 wherein the tool is a single point cutting tool.

15. The method of claim 9 wherein the anti-lubricating agent is a friction-enhancing silicone.

16. The method of claim 15 wherein the anti-lubricating agent is comprised of at least two friction-enhancing silicones.

* * * * *